United States Patent [19]

Stanton

[11] 4,421,230

[45] Dec. 20, 1983

[54] PACKAGE FOR ARTICLES OF MANUFACTURE

[75] Inventor: Allyn K. Stanton, Chicago, Ill.

[73] Assignee: Easco Corporation, Baltimore, Md.

[21] Appl. No.: 390,969

[22] Filed: Jun. 22, 1982

[51] Int. Cl.[3] ..... B65D 85/20; B65D 73/00

[52] U.S. Cl. ..... 206/378; 206/372; 206/493; 206/565; 206/820; 211/60 T

[58] Field of Search ..... 206/372, 376, 378, 493, 206/565, 820; 211/60 T

[56] References Cited

U.S. PATENT DOCUMENTS

| | | | |
|---|---|---|---|
| 1,712,473 | 5/1929 | McWethy | 206/378 |
| 2,302,045 | 11/1942 | Neumann et al. | 206/348 |
| 2,610,735 | 9/1952 | Ferguson | 206/392 |
| 2,699,866 | 1/1955 | Russell, Jr. | 206/392 |
| 3,503,493 | 3/1970 | Nagy | 206/232 |
| 3,559,802 | 2/1971 | Eidus | 206/820 X |
| 3,804,234 | 4/1974 | Gordon | 206/392 |
| 3,912,081 | 10/1975 | Haines et al. | 206/531 |
| 4,043,453 | 8/1977 | Greenlee | 206/378 |
| 4,340,141 | 7/1982 | Fischer | 206/531 |
| 4,353,465 | 10/1982 | Rado | 206/378 |

*Primary Examiner*—William T. Dixson, Jr.
*Assistant Examiner*—Brenda J. Ehrhardt
*Attorney, Agent, or Firm*—Leonard Bloom

[57] ABSTRACT

A multiple package has a top planar layer, a bottom layer, and an intermediate layer suitably bonded together to form an integral laminated structure. The intermediate layer has a plurality of projections extending through respective openings in the top layer. Articles of manufacture, such as wrench sockets, are slidably mounted over the respective projections and are retained thereon. The top and bottom layers of the multiple package are scored, both longitudinally and transversely, intermediately of the projections and to a sufficient depth, to enable an individual package to be cleanly broken off the multiple package.

7 Claims, 18 Drawing Figures

PACKAGE FOR ARTICLES OF MANUFACTURE

FIELD OF THE INVENTION

The present invention relates to a multiple package for the distribution and merchandising of various articles of manufacture, and more particularly, to a package for the shipment and subsequent display of wrench sockets, tool accessories, and the like.

BACKGROUND OF THE INVENTION

In the prior art, of which I am aware, various articles of manufacture have been packaged for display purposes in retail centers in a variety of ways. Perhaps the more conventional package constitutes a laminated "blister" pack (or "bubble" pack) having a transparent cover through which the article may be displayed to a potential retail customer. The blister pack usually has a cardboard backing printed with a trademark and other merchandising or pricing information. To remove the article, the blister pack is usually destroyed and subsequently discarded by the customer.

Additionally, the prior art has resorted to a plastic pouch having a transparent window and a pivoted flap that is folded over the sheath and secured thereto by a suitable clasp. While this type of package is reusable, nevertheless, it is primarily intended for elongated articles, such as a ratchet wrench handle, and is unsuitable for use with smaller articles of manufacture, such as wrench sockets. Besides, access to the article within the package is somewhat inconvenient.

With respect to a display package for a wrench socket, U.S. Pat. No. 4,043,453 issued on Aug. 23, 1977, has disclosed a flat cardboard strip intended on be folded along pre-arranged lines to form a triangularly-shaped hanger loop for subsequently engaging a hook on a merchandising display. The socket is suspended from the base of the triangle and is secured thereto by means of a molded retainer having parallel legs that are received within the socket. A resilient latch on the retainer snaps into the detent hole on the socket, and the socket is removed from the package by inserting an implement up through the socket to depress the latch. The object is to inhibit pilferage at the retail level.

While these prior art arrangements are perhaps satisfactory for the purposes intended, nevertheless, the packages are generally not standardized, nor are the lot sizes easily controlled; and the problem is especially pronounced where a complete line of wrench sockets of different sizes, both inch and metric, are intended to be used with several different sizes of input drive shanks. As a result, a relatively large inventory inventory of product and packaging materials is required during manufacture, shipment, distribution, and retail marketing. This is inconvenient and costly.

In an apparent attempt to alleviate some of these difficulties, the familiar blister packs have been assembled in a multiple package of perhaps a dozen individual packs, as disclosed for example in U.S. Pat. No. 2,302,045 issued on Nov. 17, 1942. In this '045 patent, the multiple package is perforated or scored, intermediately of the blisters within which the articles are packaged, and both longitudinally and transversely in a grid arrangement. As a result, an individual package may be broken off or torn off, as desired by the customer. However, since the cross-section of the package consists of two cardboard layers with a cellophane cover therebetween, which are bonded and laminated together, the break or tear will be uneven or ragged. While this defect would be insignificant at the user level, it would be unattractive and hence totally unsuitable for retail merchandising purposes.

Similar arrangements in the prior art have been shown in U.S. Pat. Nos. 3,503,493 and 3,912,081 issued on Mar. 31, 1970 and Oct. 14, 1975, respectively. Basically, these packages are generally intended for pharmaceutical storage and dispensing purposes and are unsuitable for the intended purposes of the present invention.

Moreover, in the broader category of packaging materials, designs and concepts, the prior art has disclosed shipping cartons or cases having multilayer centering supports for retaining the respective top and bottom portions of various articles of manufacture and preventing lateral movement therebetween during shipment. Examples are U.S. Pat. Nos. 2,610,735 and 2,699,866 issued on Sept. 16, 1952 and Jan. 18, 1955, respectively. Still, another example is U.S. Pat. No. 3,804,234 issued on Apr. 16, 1974, which disclosed a plastic indexing panel sandwiched between respective top and bottom panels to form an integral assembly; the assembly is then placed on the bottom of the carton. The indexing panel has a plurality of projections which extend through openings in the top panel for receiving the bottom portions of bottles or other fragile articles. The bottom flaps of the carton are sealed, the top portions of the bottles are also suitably indexed to prevent lateral movement thereof, and the top flaps of the carton are sealed.

While the various cartons shown in these prior art patents are apparently satisfactory for shipping fragile articles in interstate commerce, nevertheless their respective teachings are unsatisfactory for a combination shipping package and subsequent promotional merchandising display intended to attract consumers at the retail level and assist them in selecting various articles for purchase.

Thus, it will be appreciated that despite these isolated disclosures and teachings in the prior art patents and existing commerical practices—which are apparently intended for specific purposes and hence are somewhat isolated from one another—and despite the abundance of packaging materials and the avalanche of merchandising packages at the retail level, no one to date has combined these materials and teachings for producing a simple low-cost effective merchandisable package, especially a package adaptable for wrench sockets, tool accessories and the like, which greatly simplifies packaging and inventory control at the manufacturing and distribution level, yet by the same token, results in an attractive package for promotional merchandising to consumers at the retail level.

SUMMARY OF THE INVENTION

Accordingly, it is an object of the present invention to alleviate the disadvantages and deficiencies of the prior art by providing an improved package for various articles of manufacture, such as wrench sockets, tool accessories and the like.

It is another object of the present invention to simplify packaging at the manufacturing level and to provide a much needed degree of standardization for subsequent inventory control in warehousing and distribution, yet will result in an attractive display package suitable for promotional merchandising purposes at the retail level.

In accordance with the teachings of the present invention, a multiple package is disclosed for articles of manufacture. The package comprises a bonded laminated planar structure, preferably having a substantially rectangular plan outline, and including a top sheet or layer, a bottom layer, and an intermediate layer. The top and bottom layers are preferably formed for paper or cardboard, whereby merchandising information may be printed on the front of the top layer, and inventory control information may be printed on the back of the bottom layer. The intermediate layer is preferably molded from a suitable plastic material and has a plurality of upstanding projections integrally formed therewith and extending through respective openings formed in the top layer. These projections are arranged in respective columns and rows, and articles are fitted over the respective projections and are preferably retained thereon by an interference fit. The top and bottom layers are scored both longitudinally and transversely, intermediately of the projections and to a sufficient depth. With this arrangement, an individual package may be cleanly broken off from the multiple package, as desired, and a plurality of individual packages may be conveniently rearranged and displayed in a promotional merchandiser.

These and other objects of the present invention will become apparent from a reading of the following description, taken in conjunction with the enclosed drawings.

DESCRIPTION OF THE PREFERRED EMBODIMENT

Figure 1:
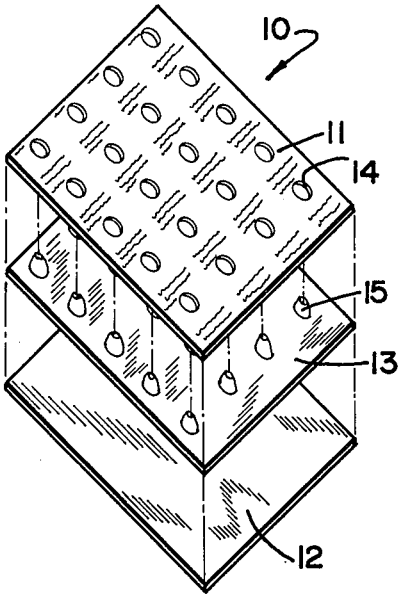
FIG. 1 is an exploded isometric view of the three planar sheets or layers from which the multiple package of the present invention is subsequently formed, the plurality of integral projections on the intermediate layer being aligned with the respective openings in the top layer.
Figure 2:
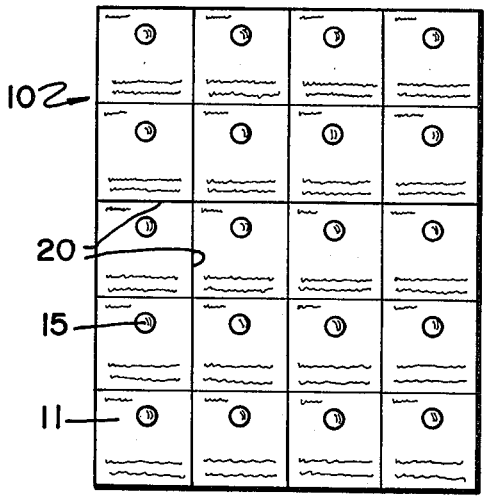
FIG. 2 is a top plan view of the layers which have been bonded together to form an integral laminated structure, which is subsequently perforated or scored both longitudinally and transversely.

With reference to FIGS. 1 and 2, there is illustrated a composite multiple package 10 preferably adapted for wrench sockets, tool accessories and the like. It will be appreciated, however, that the teachings of the present invention are not necessarily restricted for use with wrench sockets, but rather, are equally applicable to a variety of small articles of manufacture intended for retail consumption. With this in mind, the multiple package preferably comprises three planar sheets or layers, including a top layer 11, a bottom layer 12, and an intermediate layer 13. The top and bottom layers are preferably formed from paper or cardboard, while the intermediate layer is preferably molded from a suitable plastic material. These layers or sheets are somewhat flexible, yet are sufficiently rigid for handling purposes; and the sheets are nested and bonded together (using a suitable well-known technique or process) to form an integral laminated structure.

With reference again to FIGS. 1 and 2, and with further reference to FIGS. 3–10, the top layer has a plurality of openings 14 formed therein. These openings are arranged in a grid fashion in respective columns and rows, as shown in FIG. 2. Preferably, but not necessarily, a total of twenty openings are formed in the top layer. The intermediate plastic layer 13 has a corresponding plurality of upstanding tubular projections 15, formed integrally therewith, and extending through the respective openings in the top layer (as shown more clearly in FIG. 7). A wrench socket 16 is slidably mounted over a respective projection and is preferably retained thereon by a slight interference fit.

Figure 3:
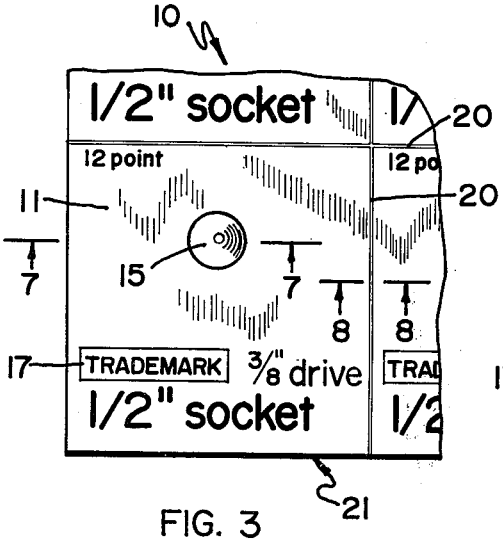
FIG. 3 is a portion of FIG. 1, drawn to an enlarged scale, and showing typical merchandising information printed on the front of the top layer.
Figure 4:
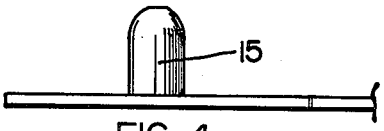
FIG. 4 is a front elevation thereof, showing an integrally-molded upstanding projection.
Figure 5:
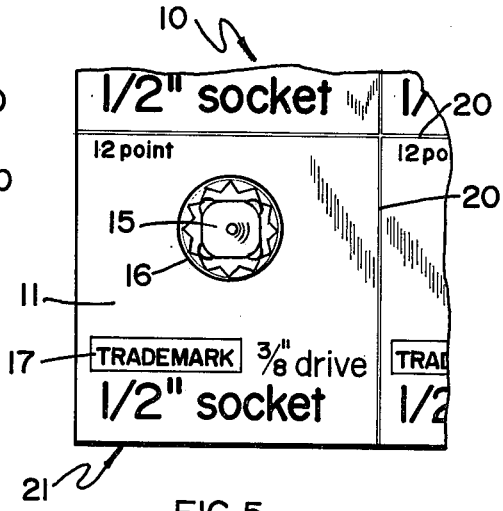
FIG. 5 corresponds to FIG. 3, but shows a wrench socket mounted over the projection and retained by an interference fit.
Figure 6:
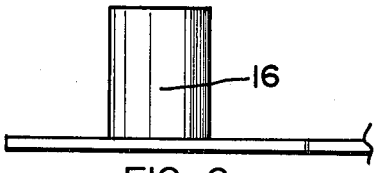
FIG. 6 is a front elevation thereof.
Figure 7:
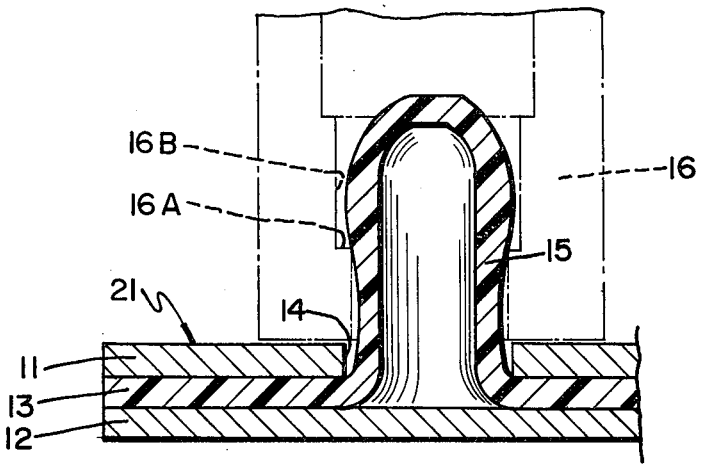
FIG. 7 is a section view, taken along the lines 7—7 of FIG. 3, drawn to an enlarged scale, and showing the socket in broken lines.

More specifically, and as shown more clearly in FIG. 7, the wrench socket has an indent or ledge 16A formed in each of the four flat sides 16B of its square-driven end. These ledges, which are intended to cooperate with the conventional ball detent on the square drive tang (not shown) engage the relatively-pliable projection and partially depress it for retaining the socket to the package with a finger-tight pressure. However, the socket may not be removed easily from the package, unless the package is itself held or retained, and this tends to inhibit pilferage at the retail level. Moreover, and as shown more clearly in FIG. 5, the substantially circular cross-section of the projection becomes somewhat square, as the relatively pliable projection conforms to the square contour of the drive portion of the socket. It will be appreciated, of course, that the degree to which the projection becomes deformed by the socket, as shown in FIGS. 5 and 7, has been somewhat exaggerated for illustration purposes. The front of the top layer may be printed with a trademark 17 and other merchandising information, as shown in FIG. 3, while the back of the bottom layer may be printed with inventory control information 18 and pricing information 19.

With reference again to FIGS. 2, 3, 8 and 9, the composite multiple package 10 is perforated or scored as at 20 (using a suitable well-known technique or process) both longitudinally and transvesrely, and intermediately of the upstanding projections, as shown in FIG. 2.

Figure 8:
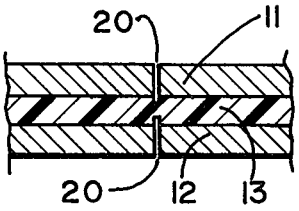
FIG. 8 is a section view, taken along the lines 8—8 of FIG. 3, and showing the details of the perforations or scorings in the top and bottom layers, respectively.
Figure 9:
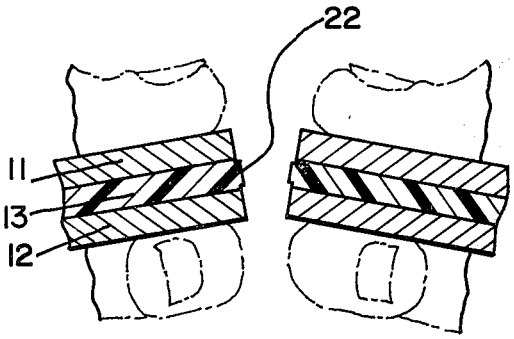
FIG. 9 corresponds to FIG. 8, but shows how an individual package may be cleanly broken off the multiple package.
Figure 10:
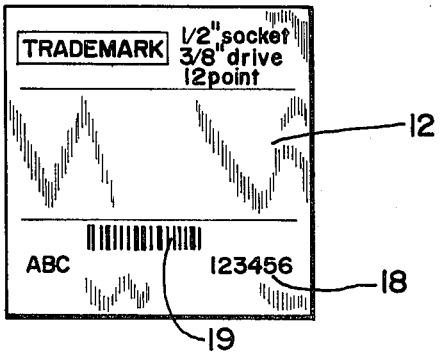
FIG. 10 is a plan view of the back of an individual package, showing the typical inventory control pricing information printed on the back of the bottom layer.

These scorings 20 are preferably made in both the top and bottom layers, and to a sufficient depth, as shown more clearly in FIG. 8. In FIG. 8, incidentally, the width of the scorings has been exaggerated for clarity of illustration. The multiple package may be conveniently grasped between the thumb and forefingers, on either side of the scoring as shown in FIG. 9, to break off an individual package 21 (with a "snap action") as needed or as desired at the retail level. With this arrangement, and of special significance, the break 22 is neat and clean, without ragged edges or tears, and thus is ideally suited for subsequent display in retail merchandising. Preferably, the individual package is substantially square in plan outline and has a side of approximately two (2) inches in length.

Figure 11:
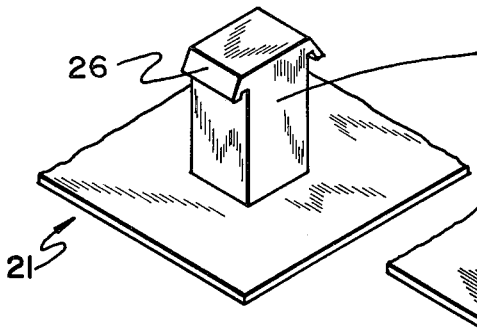
FIGS. 11–14 are respective isometric views of alternate embodiments of the integral projections.
Figure 12:
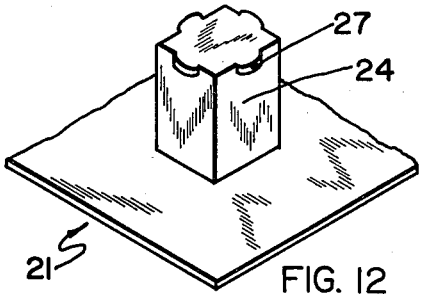
Figure 13:
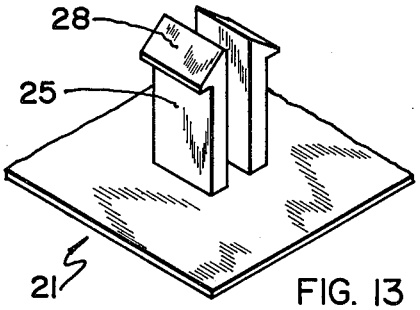

With reference to FIGS. 11–13, there are illustrated alternate embodiments of individual packages having respective projections 23, 24 and 25. These projections have respective laterally-extending resilient means which are intended to retain the wrench sockets more securely. Thus, projection 23 has tapered ledges or extensions 26, projection 24 has rounded extensions 27, and projection 25 is bifurcated and has tapered extensions 28. These resilient lateral extensions may be depressed inwardly by the wrench socket, as the socket is slidably fitted over the respective projection, so that the resilient extensions ride up over the end face 29 of the socket and snap over the socket for more securely retaining it to an individual package.

Figure 14:
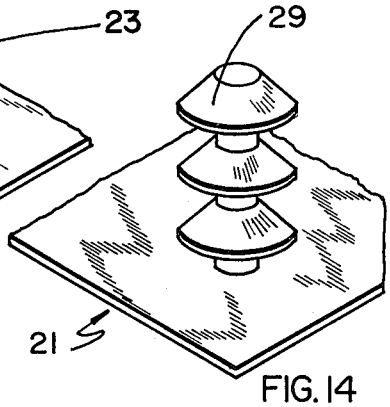

A further embodiment is shown in FIG. 14, wherein the projection 29 has a so-called "Christmas Tree" configuration; this may be suitable if the intermediate plastic layer would be injection molded.

Figure 15:
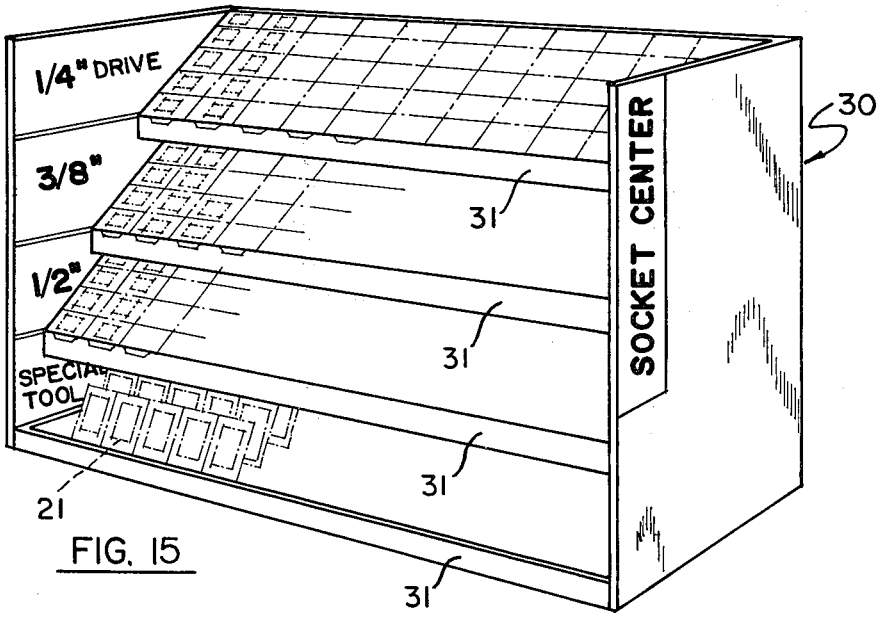
FIG. 15 is an isometric view of a promotional counter display for merchandising the individual packages at the retail level.

With reference to FIG. 15, a promotional merchandiser 30 provides an attractive counter display. The individual packages 21 are arranged in a substantially vertical, but inclined manner, along respective shelves or tiers 31. As shown, four tiers may be provided for $\frac{1}{4}$, $\frac{3}{8}$ and $\frac{1}{2}$ inch drives, respectively, and for additional accessories or special tools on the bottom tier.

Figure 16:
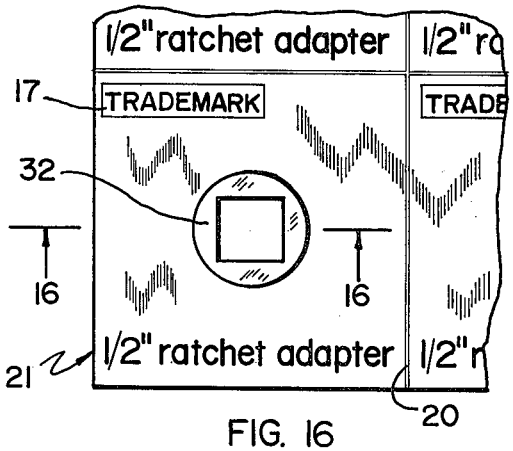
FIGS. 16–18 illustrate an alternate embodimemt, wherein the article of manufacture is received within the tubular projection formed on the intermediate layer.
Figure 17:
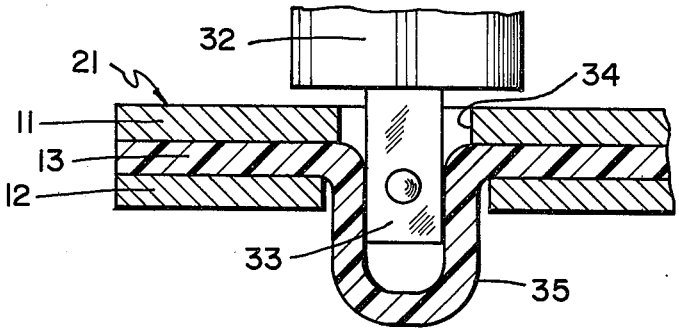
Figure 18:
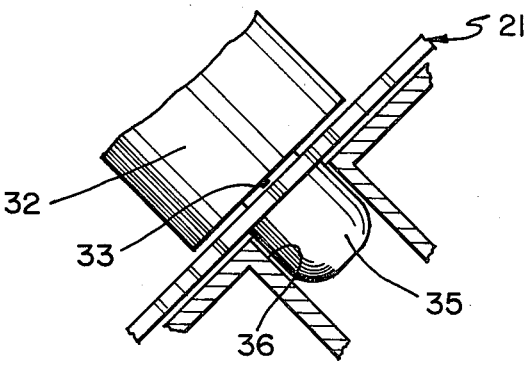

An alternate embodiment is illustrated in FIGS. 16–18. There, the individual package is "reversed", that is, the article of manufacture 32 is received within the projection, which is tubularly formed, rather than being received over the projection. The article of manufacture has a driving male tang (or stud) 33 passing through an opening 34 in the top planar layer (or member) and is received within the tubular projection 35, again with a slight interference fit. The driving tang may be formed integrally with any component of a wrench socket kit, such as a ratchet adapter. The individual package, after being broken off from the multiple package (as previously described), may be mounted within a suitable slotted opening 36 formed in the display merchandiser.

Thus, the following advantages are realized from the present invention: The packaging materials, comprising the sheets 11, 12 and 13, are standardized and are in a convenient rectangular form for mounting a fixed number of wrench sockets (preferably a total of twenty). The trademark and merchandising information which is printed on the front of the top layer, as well as the pricing and inventory control information printed on the back of the bottom layer, may be changed conveniently by the manufacturer for quickly adapting the product line to the requirements of different mass merchandisers, wholesalers, and purchasing cooperatives. Since the size and shape of the multiple package is standardized, the shipping cartons are also standardized for minimum order purposes and for standard lot sizes. This substantially simplifies the packaging and inventory requirements, not only at the point of manufacture, but also in subsequent distribution. Yet at the retail level, the individual packages may be quickly broken off into multiple packages, easily rearranged according to drive size, and placed in an attractive merchandiser for displaying and promoting the product line to prospective retail customers. Moreover, the customer does not have to destory the package (as is the case with blister packs) but may, if desired, continue to use the packages to more quickly locate the different sizes of wrench sockets and select the socket of the desired size.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A multiple package for distribution and merchandising of wrench sockets, tool accessories, and the like, comprising a bonded laminated planar structure having a substantially rectangular plan outline and including a top layer, a bottom layer, and an intermediate layer, one of the top or bottom layers having a plurality of openings formed therein, the openings being spaced apart from one another and being arranged in respective columns and rows, the intermediate layer being formed from a plastic material and having a plurality of projections formed integrally therewith, the projections extending through the respective openings in the one layer, whereby the wrench sockets, tool accessories, and the like may be carried by the respective projections and retained by a slight interference fit, and the top and bottom layers being scored both longitudinally and transversely, intermediately of the projections and to a sufficient depth which extends partially into the intermediate plastic layer from at least one side thereof, whereby, as desired, an individual package may be cleanly broken off the multiple package by a "snap action".

2. The package of claim 1, wherein the intermediate plastic layer is scored from both sides thereof.

3. The package of claim 1, wherein merchandising information is printed on the exposed surface of the top layer.

4. The package of claim 1, wherein inventory control information is printed on the exposed surface of the bottom layer.

5. The package of claim 1, wherein the respective openings are formed in the top layer, wherein the projections are substantially tubular and extend upwardly through the respective openings in the top layer, and wherein the wrench sockets are received over the projections and are carried thereby.

6. A multiple package for distribution and merchandising of wrench sockets, tool accessories, and the like, comprising a bonded laminated planar structure having a substantially rectangular plan outline and including a top layer, a bottom layer, and an intermediate layer, whereby merchandising information may be printed on the exposed surface of the top layer, and whereby inventory control information may be printed on the exposed surface of the bottom layer, the top layer having a plurality of openings formed therein, the openings being spaced apart from one another and being arranged in respective columns and rows, the intermediate layer being formed from a plastic material and having a plurality of upstanding tubular projections formed integrally therewith, the projections extending through the respective openings in the top layer, whereby the wrench sockets, tool accessories, and the like may be carried by the respective projections and retained by a slight interference fit, and the top and bottom layers being scored both longitudinally and transversely, intermediately of the projections and to a sufficient depth which extends partially into the intermediate plastic layer from both sides thereof, whereby, as desired, an individual package may be cleanly broken off the multiple package by a "snap action".

7. A multiple package for distribution and merchandising of wrench sockets, tool accessories, and the like, comprising a bonded laminated planar structure having a substantially rectangular plan outline and including a pair of layers, one of which has a plurality of openings formed therein, the openings being spaced apart from one another and being arranged in respective columns and rows, the other layer having a plurality of projections formed integrally therewith, the projections extending through the respective openings in the one layer, whereby the wrench sockets, tool accessories, and the like may be carried by the respective projections and retained by a slight interference fit, and the one layer being scored both longitudinally and transversely, intermediately of the projections and to a sufficient depth which extends partially into the other layer, whereby, as desired, an individual package may be cleanly broken off the multiple package by a "snap action".

* * * * *